US006122774A

United States Patent [19]

Park

[11] Patent Number: 6,122,774

[45] Date of Patent: Sep. 26, 2000

[54] FREE SIZE CAP

[75] Inventor: Boo Yl Park, Seoul, Rep. of Korea

[73] Assignee: DADA Corp., Seoul, Rep. of Korea

[21] Appl. No.: 09/218,304

[22] Filed: Dec. 22, 1998

[51] Int. Cl.[7] ..... A42C 5/02

[52] U.S. Cl. ..... 2/181; 2/181.2; 2/183; 2/195.3

[58] Field of Search ..... 2/181, 183, 195.3, 2/181.2, 195.7

[56] References Cited

U.S. PATENT DOCUMENTS

| | | | |
|---|---|---|---|
| 2,052,123 | 8/1936 | Adamson | 2/183 |
| 2,106,075 | 1/1938 | Tabley | 2/181 |
| 4,023,212 | 5/1977 | Huffman | 2/197 |
| 4,141,229 | 2/1979 | Sharpe | 66/171 |
| 4,165,542 | 8/1979 | McLaughlin | 2/209.1 |
| 4,378,606 | 4/1983 | Snowden | 2/198 |
| 4,393,519 | 7/1983 | Nicastro | 2/12 |
| 4,491,985 | 1/1985 | Dalton | 2/171 |
| 4,551,859 | 11/1985 | Gerhardt | 2/172 |
| 4,608,721 | 9/1986 | Lipkin | 2/172 |
| 4,642,817 | 2/1987 | Ferstenfeld | 2/183 |
| 4,662,007 | 5/1987 | Lipkin | 2/195 |
| 4,845,782 | 7/1989 | Gregg | 2/172 |
| 5,012,532 | 5/1991 | Krystal | 2/197 |
| 5,070,545 | 12/1991 | Tapia | 2/195 |
| 5,119,514 | 6/1992 | Woehl | 2/195 |
| 5,153,939 | 10/1992 | Howe et al. | 2/69 |
| 5,161,260 | 11/1992 | Reynolds | 2/207 |
| 5,272,772 | 12/1993 | Hahn | 2/195.2 |
| 5,428,843 | 7/1995 | Clowers et al. | 2/195.2 |
| 5,481,759 | 1/1996 | Rinaldi | 2/195.1 |
| 5,615,415 | 4/1997 | Beckerman | 2/183 |
| 5,715,540 | 2/1998 | Cho | 2/195.3 |
| 5,862,522 | 1/1999 | Cho | 2/195.1 |

*Primary Examiner*—Diana Oleksa

*Attorney, Agent, or Firm*—Jacobson, Price, Holman & Stern, PLLC

[57] ABSTRACT

A free-size cap is capable of fitting wearers having a range of head sizes. The free-size cap structure is further provided with inwardly folded portion at the crown edge, and with a flexible material therein. The cap has a number of axially stretchable gores to enhance the comfort of the cap and to avoid a tight-fitting structure. The structure permits free-size cap to be fabricated which are comfortable for the wearer, and with a single size of cap being adaptable for use by all persons with heads within a number of normal sizes.

12 Claims, 3 Drawing Sheets

FREE SIZE CAP

FIELD OF THE INVENTION

The present invention relates generally to an improved cap structure, and more particularly to an improved free-size cap having a typical baseball cap configuration, and with one cap being adapted to accommodate a variety of sizes of heads.

BACKGROUND OF THE INVENTION

It shall be understood that caps of the baseball cap style are marketed in a variety of ways. These caps are marketed through conventional retail outlets, and have also found a substantial market as promotional items. In the marketing of outer wear products, it is, of course, more economical to provide such products with a minimal numbers of sizes. Thus, economy of numbers may be achieved through utilization of caps of the multi-size variety.

In addition to typical marketing, various types of business entities provide such promotional items to employees and/or customers, and in these instances, the outer surface of the crown at a point above the visor may carry an emblem, or other indicia identifying the business entity. Because of the manner in which these products are marketed, it is, of course, desirable to utilize the products with minimal size variation requirements, hence the free-size caps become extremely desirable for the customer.

As is conventional, baseball caps employ a crown portion to which a visor is secured to the forward edge of the crown and extends outwardly therefrom.

In utilization of caps for outer wear, it is desirable for the forward portion to be somewhat rigid so that, for appearance purposes, the crown portion stands somewhat erect. Also such an arrangement will normally provide a means for the visor portion to be rigid, durable, and extend generally forwardly of the wearer's forehead. Accordingly, the front gores or panels may be fitted and/or stiffened by suitable means in order to stand generally erect during wear.

In the past, attempts have been made to provide free-size cap structures of the baseball cap style, and such caps are in wide-spread use today. Typically, free-size caps are created through the utilization of a variable-length snap arrangement which permits the user to adjust the cap size as required. Such caps are frequently of the single or fixed size variety.

More recently, attempts have been made to provide free-size cap of the baseball cap type or style which do not utilize a variable-length snap arrangement. An example of such a cap is disclosed in U.S. Pat. No. 5,715,540 to B. W. Cho. In the Cho patent, a free-size cap comprises a main body having a plurality of gores forming a crown portion having a lower peripheral edge wherein at least some of the plurality of gores are composed of uniaxially stretchable fabric aligned to stretch only in a peripheral direction; and a sweat band connected to the lower peripheral edge of the crown portion, said sweat band being a single unfolded stretchable sheet in structure such as a elastic band so that it is adjustable together with the main body to fit various head sizes.

However, such caps cause a sense of oppression to the wearers since it uses a high elastic sweat band and does not keep its shape when not in use.

It is desirable to provide a cap which is more simply produced, attractive in use, comfortable for the wear by causing no oppression, and further provides the advantageous feature of multiple size capability. Such cap designs are utilized by individuals for a variety of outdoor purposes, including work purposes as well as sport purposes, including such sports as hunting, fishing, and the like.

SUMMARY OF THE INVENTION

Therefore, it is a primary object of the present invention to provide an improved baseball-type cap for fitting multiple sizes which includes a double folded portion, playing the role of headband, in the lower peripheral portion of a the crown.

It is a further object of the present invention to provide a baseball-type cap structure capable of multi-size use, which can be manufactured utilizing conventional materials and fabrics, and which is both functional and attractive in its use and appearance.

It is yet a further object of the present invention to provide an improved free-size cap structure of the baseball-type cap, which employs inwardly folded portion elongated from the crown so that it works as a conventional headband, and a flexible material in the above portion, thereby avoiding the oppression to the wearers' forehead as well as diminishing the manufacturing process.

It is still a further object of the present invention to decrease the quantity of stock in a manufacturing and/or a selling agency due to the wider accommodation range of the cap.

In order to achieve the foregoing objects, the free-size cap structure of the present invention is provided with inwardly folded portion at the crown edge so that it works as a conventional headband, and with a flexible material therein. The cap has a number of axially stretchable gores to enhance the comfort of the cap and to avoid a tight-fitting structure. The structure of the present invention permits free-size cap to be fabricated which are comfortable for the wearer, and with a single size of cap being adaptable for use by all persons with heads within a number of normal sizes.

Other and further objects of the present invention will become apparent to those skilled in the art on consideration of the accompanying drawings and following specification wherein are disclosed several exemplary embodiments of the invention with the understanding that such variations, modifications and elimination of parts may be made therein as fall within the scope of the appended claims without departing from the spirit of the invention.

BRIEF DESCRIPTION OF THE DRAWINGS

FIGS. 2–1 is an enlarged cross-sectional view of the portion 5 in FIG. 2;

DESCRIPTION OF THE PREFERRED EMBODIMENT

Figure 1:
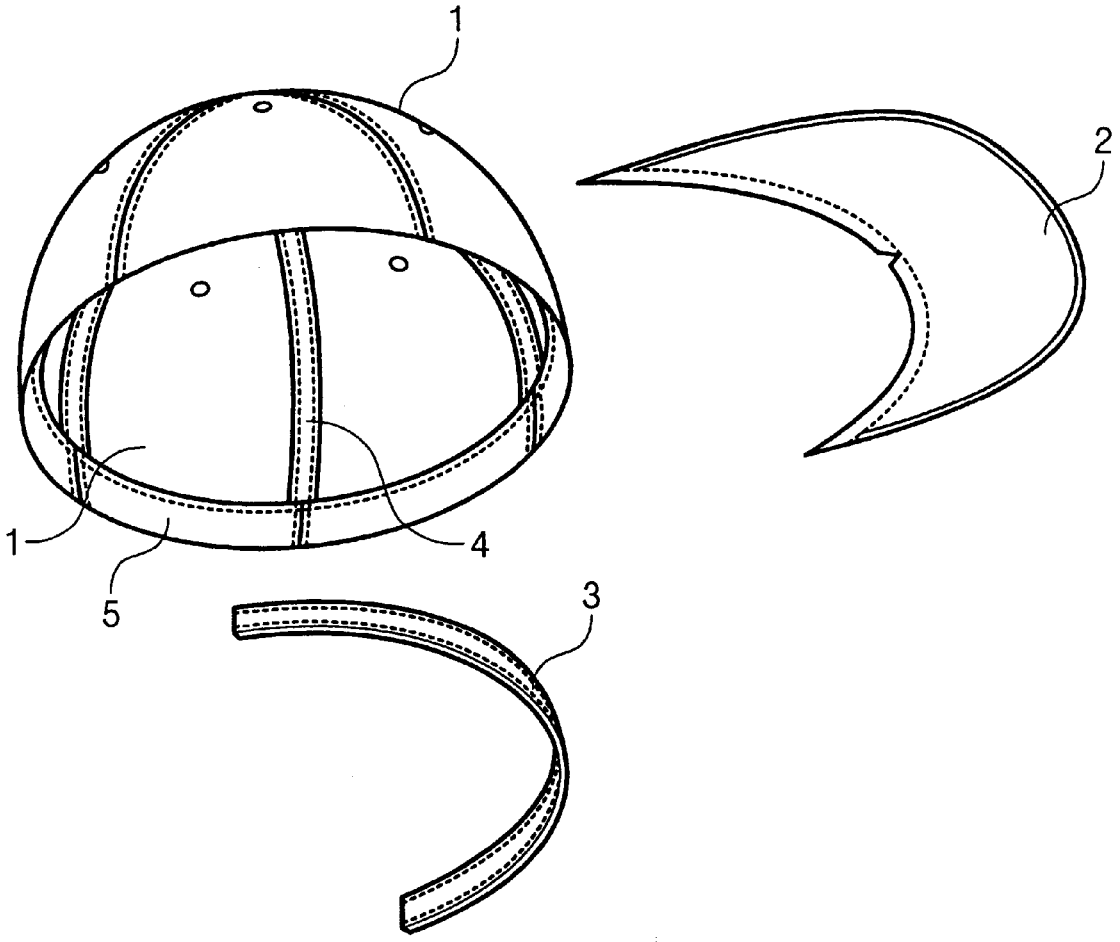
FIG. 1 is a disassembled perspective view of a free-size cap of the present invention.
Figure 2:
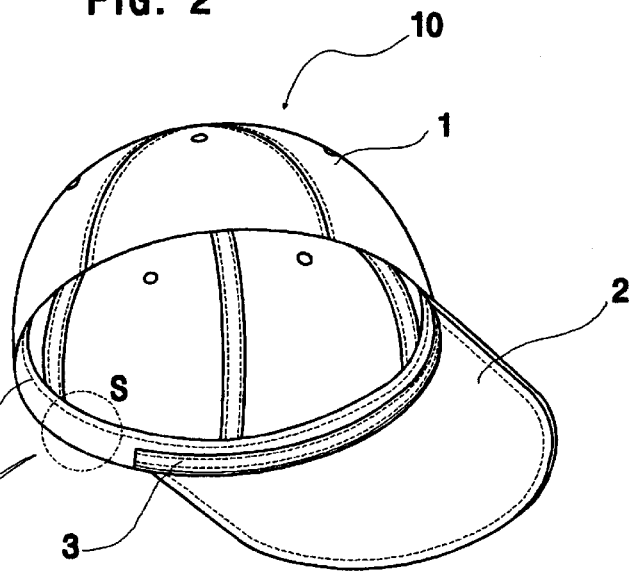
FIG. 2 is an assembled perspective view of the free-size cap.
Figures 1, 2:
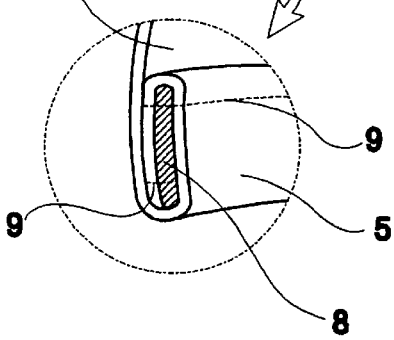

Referring first to FIGS. 1 and 2, a free-size cap structure generally designated by 10 comprises a crown portion 1 which is fabricated with several fabric segments(panel or gore) 1-1, 1-2, 1-3, 1-4, 1-5 and 1-6; a visor 2; a sweat band 3; bias tape 4, and a sponge 8 which is optional.

A crown is formed of individual gores such as gores 1-1, 1-2, 1-3, 1-4, 1-5 and 1-6, at least some of which are fabricated by uniaxially or biaxially stretchable woven or non-woven fabrics such as "Spandex" or "Lycra". Seams of each gore are assembled by stretchable or non-stretchable bias tape 4 which functions as an inter-coupling member.

The visor 2 may be attached to the crown portion 1 in a conventional way so that it extends away from the crown portion 1 at a desirable angle or tilt. The visor, as previously indicated, is normally somewhat rigid, and hence is not stretchable. Thus, the gores 1-1 and 1-2 which are attached by the visor 2 need not be fabricated by stretchable fabrics.

In the present invention, the lower peripheral portion 5 extended from the crown portion 1 is inwardly folded once, twice or more times around the crown 1 by the width of the normal headband so that it works as the headband, and then at 9 if necessary. In order to provide rigidity with folded lower peripheral portion 5, flexible material such as sponge 8 may be accompanied therein.

The gores 1-1 and 1-2, which are connected to the visor 2, are, in the preferred embodiment, formed of stretchable material, however the visor 2 prevents it from stretching and therefore the gores are not necessarily fabricated by the stretchable fabrics.

Since the folded fabrics are working as the headband in the present invention, is not necessary to attach an additional head band around the lower peripheral of gores 1-1, 1-2, 1-3, 1-4, 1-5 and 1-6. In the present invention, however, the visor 2 is attached to the lower peripheral portion of the gores 1-1 and 1-2, and a sweat band 3 formed of any suitable material may be attached to that area. Since the visor 2 is rigid and non-stretchable, the sweat band 3 need not be stretchable. Adjacent visor 2 in the sweat band is fabricated with the material capable of absorbing the sweat or like.

FIG. 2-1 illustrates the cross-sectional view of inwardly folded portion 5 of the crown 1, in the flexible material like sponge 8 is accompanied therein.

Figure 3:
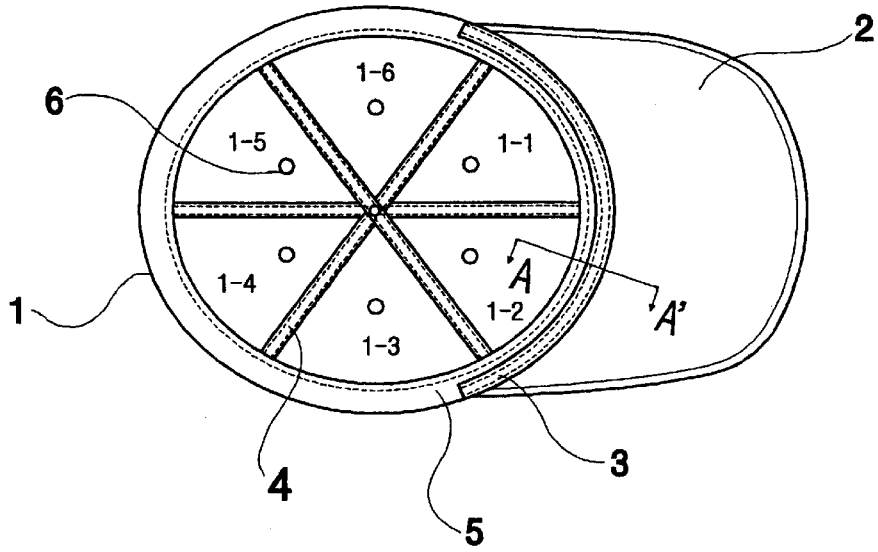
FIG. 3 is a bottom view of the free-size cap shown in FIG. 2 showing the interior of the crown portion of the free-size cap.

FIG. 3 which is a bottom view of the free-size cap 10 shown in FIG. 2, shows the folded portion 5 arranged along the periphery of the interior of the crown edge of the free-size cap of the present invention, and bias tape 4 assembling the respective gores. Extended portion 5 from the crown portion 1 is fabricated with the same material as crown 1, so that it can stretch along with the stretching gores, 1-3, 1-4, 1-5, and 1-6.

Figure 4:
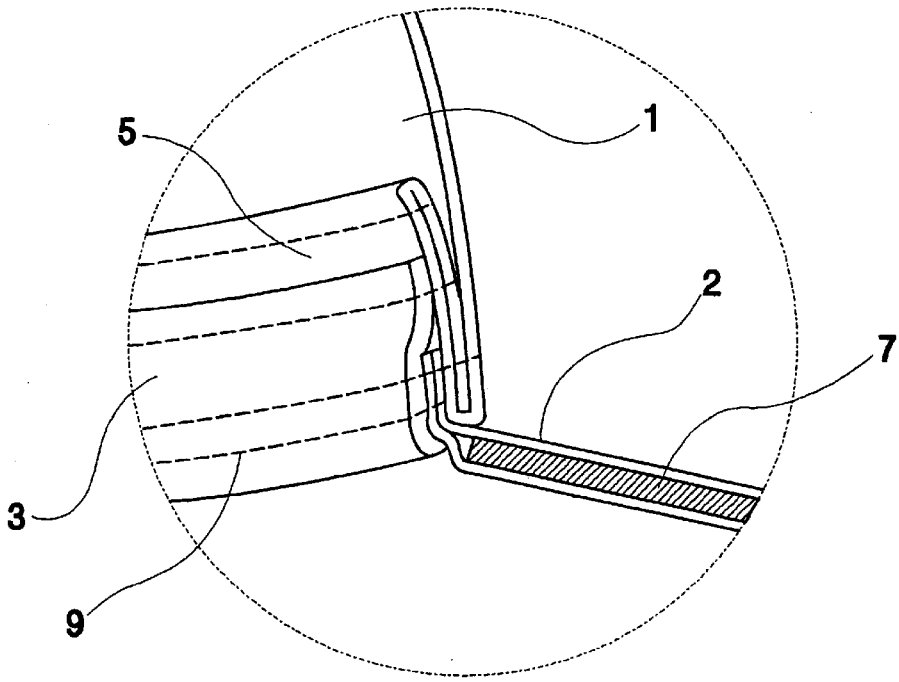
FIG. 4 is an enlarged cross-sectional view of the line A–A' in FIG. 3.

FIG. 4 shows the way of attaching the folded portion 5, visor 2 and sweat band 3. As shown in the drawing, the visor 2 is attached to the inside of the folded portion 5 with a conventional way. The sweat band 3 is attached on the sewing margin of the visor so that the margin is not visible from the outside. Accordingly, the width of the sweat band used in the present invention may be larger than the width of the sewing margin of the visor but less than the width of the headband normally used. It is preferable that the length of the sweatband is a little bit longer than the peripheral length of the visor 2 so that it covers the sewing margin of the visor 2.

It shall be noted that even though the invention is described only for a baseball-type cap in the above stated embodiment, the technical concept of the present invention is also applicable to any other head wears similar to a cap.

Furthermore, it will be appreciated that various modifications of the present invention may be undertaken by those skilled in the art without departing from the spirit and scope hereof.

What is claimed is:

1. A free-size cap comprising:

a main body having a plurality of gores forming a crown portion with a lower peripheral edge, wherein at least some of said plurality of gores are composed of stretchable material aligned to stretch at least in a peripheral direction; the lower peripheral portion of said crown portion being folded inwardly to form a headband; and a sweat band attached to a segment of said lower peripheral edge of said crown portion to which a visor is attached, said sweat band being a non-stretchable material having a width larger than a sewing margin of the visor but less than a width of the headband and having a length longer than a peripheral length of said visor.

2. The free-size cap as claimed in claim 1, wherein the lower peripheral portion of said crown portion is folded inwardly twice.

3. The free-size cap as claimed in claim 1, wherein a flexible material is accompanied in the headband.

4. The free-size cap as claimed in claim 3, wherein said flexible material is a sponge.

5. A headwear comprising a main body having a crown with a lower peripheral edge and a headband formed by folding the lower peripheral edge of said crown inwardly, wherein the lower peripheral edge is folded inwardly twice.

6. The headwear of claim 5, further comprising a visor connected along a segment of said crown and a sweat band attached to the lower peripheral edge along the segment of said crown.

7. The headwear of claim 5, wherein the crown is formed by a plurality of panels.

8. The headwear of claim 7, wherein at least some of the plurality of panels are composed of stretchable material aligned to stretch at least in a peripheral direction.

9. The headwear of claim 7, wherein at least some of the panels are non-woven.

10. The headwear of claim 7, wherein at least some of the panels are uniaxially stretchable.

11. The headwear of claim 5, further comprising a flexible material accompanied in the headband.

12. The headwear of claim 11, wherein said flexible material is a sponge.

* * * * *